United States Patent [19]

Desourdy

[11] 3,957,124

[45] May 18, 1976

[54] TUNNEL-DRILLING TRUCK

[76] Inventor: Bernard Desourdy, 309 deNormandie St., Longueuil, Quebec, Canada

[22] Filed: Jan. 14, 1975

[21] Appl. No.: 541,073

[30] Foreign Application Priority Data

Aug. 16, 1974 Canada .....207170

[52] U.S. Cl. ..... 173/28; 173/43; 173/52; 248/13

[51] Int. Cl.² ..... E21C 11/02

[58] Field of Search ..... 173/28, 43, 52, 22; 248/2, 13, 16

[56] References Cited

UNITED STATES PATENTS

| | | | |
|---|---|---|---|
| 2,026,627 | 1/1936 | Gilman | 173/52 X |
| 2,069,830 | 2/1937 | Hirschberg | 173/52 X |
| 2,614,807 | 10/1952 | Curtis | 248/13 |
| 3,729,056 | 4/1973 | Paurat | 173/52 X |
| 3,768,574 | 10/1973 | Long | 173/52 X |
| 3,815,690 | 6/1974 | Cooper | 173/28 X |

*Primary Examiner*—Ernest R. Purser
*Assistant Examiner*—William F. Pate, III

[57] ABSTRACT

A truck provided with drill units to drill the end wall of a tunnel under excavation, this truck being characterized by having a support for the drill units, which is pivoted about a transverse axis relative to the vehicle body to provide adjustment of the inclination of the support in relation to the inclination of the end wall to be drilled, to allow adjustment of the overall height of the truck for tunnels of different heights, and to provide a better load distribution to allow faster travel. This support is pivotally connected to provide automatic and constant aiming of the drill units in parallel rearwardly pointing relationship.

4 Claims, 5 Drawing Figures

TUNNEL-DRILLING TRUCK

This invention relates to drilling to effect tunneling and, more particularly, to a truck of the type provided with a plurality of drills for concurrent multi-hole drilling particularly into the end wall of a tunnel being excavated.

The above-mentioned type of tunnel-drilling truck has so far been equipped with drill units rigidly supported by any appropriate structure relative to the vehicle body. This rigid connection or support relative to the vehicle body is disadvantageous in particular with the big trucks equipped to drill in tunnels of substantial height, such as of over 20 feet. According to the prior art, such trucks have been provided with a plurality of overlying drill units such that, when the end wall of the tunnel is inclined, as often occurs, the drills could not reach the same depth. There resulted a reduced efficiency of such truck, less rock blasted each time and, consequently, a slower progress of the tunneling operation. Since the afore-mentioned trucks of the prior art are of constant height, they cannot be used to drill tunnels of smaller cross-sections. Besides, these anterior trucks alway carry the drill units in fixed operative position at the rear and the resulting poor load distribution makes it mandatory to drive these trucks at crawling speeds with the resultant loss of valuable time.

It is a general object of the present invention to provide a tunnel-drilling truck of the above type, which is relatively more versatile and efficient in particular with regard to speed of travel and adjustments to different heights of tunnel and to the inclinations of the face to be drilled.

It is a more specific object of the present invention to provide a tunnel-drilling truck of the above type which allows lowering of the overall height of the truck for use of the latter in tunnels of various heights, which allows displacement of the support and the drill units for a better loading of the truck body for travel than when in the operative drilling position, and which allows to position the drill units in relation to the inclination of the face of the tunnel to more efficiently make the drills bore all to the same maximum depth.

It is a specific object of the present invention to provide a tunnel-drilling truck of the above type to produce the afore-mentioned advantages by providing a pivoted support for the drills.

It is another object of the present invention to provide a truck of the above type, which enables to drill anchor bolt holes in the roof of the tunnel along several longitudinally spaced arcs at the same time.

The above and other objects and advantages of the present invention will be better understood in the light of the following detailed description of a preferred embodiment thereof, which is illustrated, by way of example, in the accompanying drawings, wherein.

Figure 2:
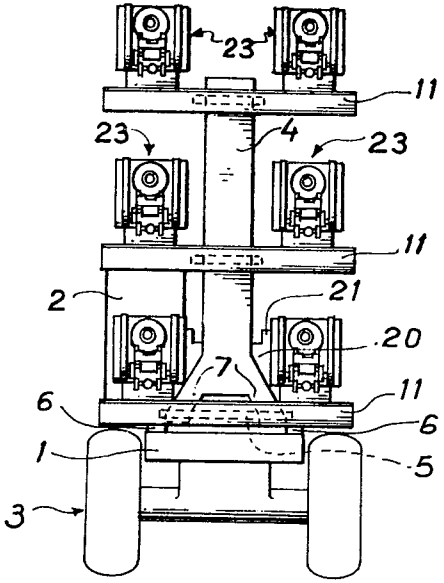
FIG. 2 is a rear view of the truck of FIG. 1 as seen from the right in the latter.
Figure 1:
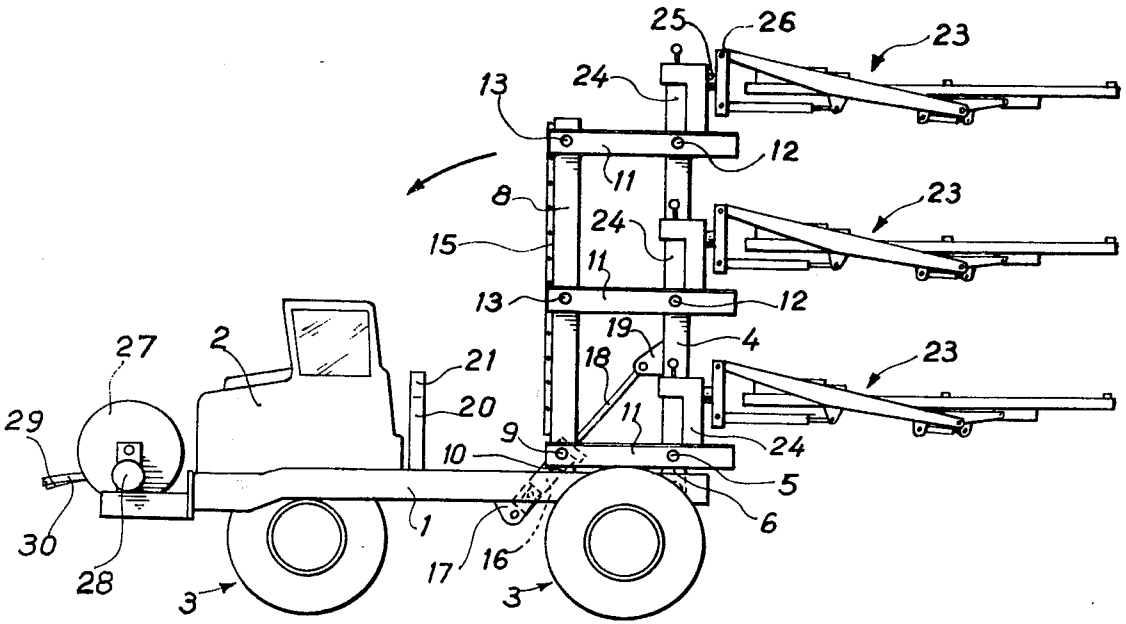
FIG. 1 is a side elevation view of a tunnel-drilling truck according to the present invention and shown in operative position.
Figure 3:
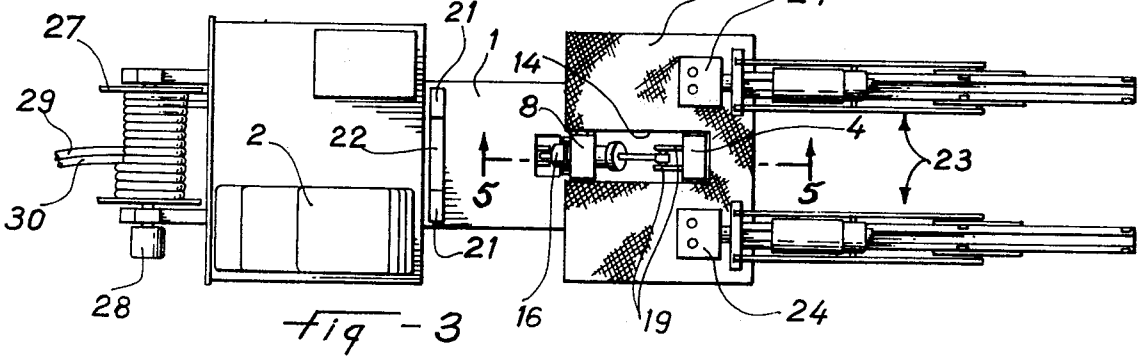
FIG. 3 is a top plan view of the truck of FIG. 1.

The illustrated tunnel-drilling truck includes a truck body formed by a chassis 1 and a cab 2 carried by a pair of wheels and axle assemblies 3.

A mast, formed by a rigid arm 4, is pivoted to the vehicle chassis 1 by a pin 5 secured to suitable brackets 6 projecting upwardly from the vehicle chassis. The arm 4 is thus pivoted about a transverse axis relative to the truck body. The arm 4 has a lower end spreading into a pair of laterally spaced-apart legs 7 separated by a central space.

A mechanism is provided to aim the drills carried by the truck and includes a second rigid arm 8, similar to the arm 4 and similarly pivoted about a transverse axis relative to the truck body by a pin 9 secured to brackets 10. The above-mentioned mechanism further includes a set of three work platforms 11 forming cross members pivoted to the rigid arms 4 and 8 by pins 12 and 13 respectively. The pins 9 and 13 are arranged in the same spaced-apart parallel relationship along the rigid arm 8 as the pins 5 and 12 along the rigid arm 4. Thus, the arms 4 and 8 and the work platforms 11 are arranged in parallelogram relationship by the parallelogram pivotal connection defined by the pivot pins 5, 9, 12, and 13. Consequently, the mast unit formed by the rigid arm 4 pivots in constant parallel relationship relative to the rigid arm 8, while the same happens with the work platforms 11.

Each work platform 11 has a planar U-shaped configuration defining a pair of laterally spaced-apart lateral sections separated by a central space 14 into which the rigid arms 4 and 8 are positioned and pivotally held by the corresponding pivot pins. A ladder 15 is secured against the front face of the rigid arm 8.

A hydraulic cylinder unit is provided to pivot the rigid arms 4 and 8 and includes a hydraulic cylinder 16 pivotally connected to brackets 17 rigidly secured to the truck chassis 1 and a piston 18 pivotally connected to the brackets 19 rigidly secured to the rigid arm or mast 4.

Figure 4:
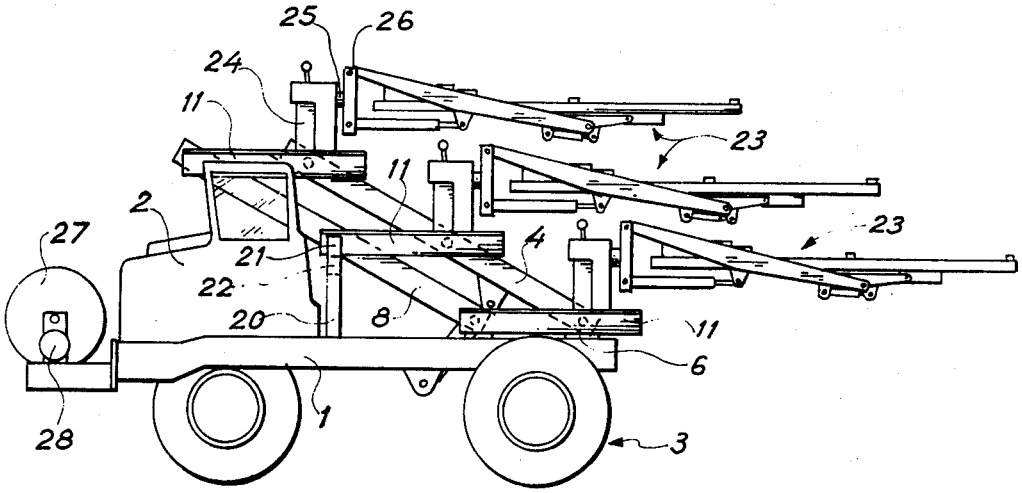
FIG. 4 is a side elevation view of the truck of the preceding Figures but shown in the position for travel.
Figure 5:
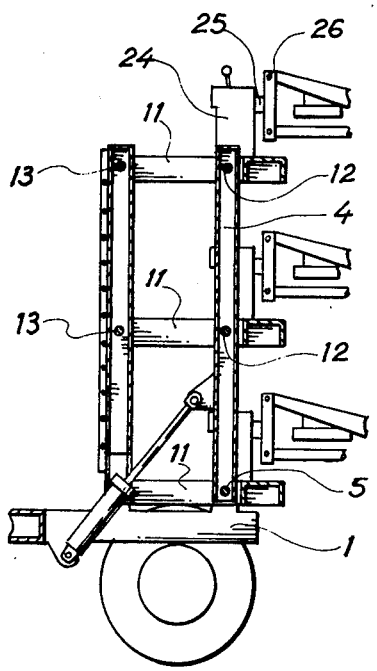
FIG. 5 is a cross-sectional view as seen along line 5—5 in FIG. 3.

A support 20 is secured on the truck chassis 1 forwardly of the mast unit and is provided with a pair of laterally spaced-apart upward projections 21 defining a central recess 22 of sufficient width to rest the rigid arm 8 therein when the mast unit is lowered forwardly into stowed position, as shown in FIG. 4.

A drill unit 23, of conventional construction, is rigidly mounted onto each platform 11 by a base 24 forming a control console. As is known in the art, these drill units are rotatable about a horizontal pivot 25 and are vertically pivoted about a transverse axis at 26. Thus, the drill of each drill unit 23 may be pointed in any direction defined within a hemisphere which is coaxial with the pivot 25 and stands rearwardly thereof.

A reel 27 is rotatably mounted on the front of the truck body and a motor 28 is connected thereto to rotate the same in one angular direction while allowing free rotation thereof in the opposite angular direction. A pair of hoses 29 and 30 are coiled on the reel 27 to effect reeling thereof upon energization of the motor 28 and to allow unreeling upon pulling thereon. The hoses are provided for connection to a remote water and compressed air supply.

The afore-described tunnel-drilling truck is adapted to effect horizontal drilling of six parallel bores into the end wall of a tunnel under excavation. When the rigid arms 4 and 8 are in fully upright position, the six bores are drilled to the same depth in a vertical wall. If the face of the end of the tunnel is inclined, the hydraulic cylinder unit may be actuated to position the rigid arms 4 and 8 parallel to the inclined face. Thus, all the drill units can drill to the same depth irrespective of the end face inclination and allows more efficient drilling and blasting.

The overall height of the truck can be reduced by either pivoting down the rigid arms or by removing the uppermost drill units 23.

This truck may also be used to drill straight up or straight laterally, such as to efficiently drill for rock bolting. The arms 4 and 8 are inclined forwardly of the truck and three series of anchor bolt holes can be drilled at the same time along three arcs longitudinally spaced about 7 feet apart along the length of the tunnel. In other words, all of the six drill units can be used for rock bolting.

The hoses 29 and 30 may be simply connected by pulling thereon until a sufficient length thereof has been unreeled to allow connection to the water and compressed air supply.

When the rigid arms 4 and 8 are collapsed or lowered to the stowed position, as in FIG. 4, the center of gravity of the truck is both lowered and longitudinally centered allowing a relatively fair travel speed for the truck.

I claim:

1. A tunnel-drilling truck comprising a vehicle body, wheels and axle assemblies supporting the vehicle body, a rigid mast unit bodily pivoted to the vehicle body about a transverse axis relative to the latter and upwardly projecting endwise from the vehicle body, said rigid mass unit constituted of first and second rigid arms pivoted onto said vehicle body about a pair of parallel pivot axes transverse to said vehicle body, said first and second rigid arms being arranged in parallel spaced-apart relationship one ahead of the other lengthwise of said vehicle body, and centrally transversely of the latter, a series of work platforms extending generally parallel to said vehicle body, each having a pair of laterally spaced-apart portion laterally straddling said first and second rigid arms and pivotally connected to both rigid arms by transverse pins, whereby said first and second rigid arms form a parallelogram arrangement with said work platforms, an actuating device connected to the vehicle body and to the mass unit and operatively bodily pivoting the latter about said transverse axes, said work platforms remaining substantially horizontal irrespective of the inclination of said rigid arms, and elongated drill units mounted on said platforms, said platforms maintaining the drill units in a predetermined aiming relationship independently of the angular position of the rigid arms relative to the vehicle body.

2. A tunnel-drilling truck as defined in claim 1, wherein each of said drill units includes a base rigidly mounted on the corresponding work platform, and said actuating device includes a hydraulic cylinder connected at one end to said rigid mast unit and at the other end to said vehicle body forwardly of said mast unit for bodily pivotal displacement of the latter between an upright operative position and a forwardly stowed position in overlying relationship relative to the vehicle body.

3. A tunnel-drilling truck as defined in claim 2, wherein said mast unit is pivoted on the rear end of said vehicle body, said drill units project rearwardly relative to said vehicle body, and a support is secured to said body forwardly of said mast unit and adapted to carry the latter in said forwardly stowed position.

4. A tunnel-drilling truck as defined in claim 3, further including a reel rotatably secured to the front end of said vehicle body, a drive connected to said reel and arranged to effect unidirectional reeling and to allow free unreeling thereof in opposite angular directions respectively, and a pair of hoses connected to said reel and coiled thereon in the appropriate direction to effect reeling thereof upon operation of said drive and to freely unreel upon pulling on the outer ends thereof.

* * * * *